US010053898B1

(12) United States Patent
Lashley et al.

(10) Patent No.: US 10,053,898 B1
(45) Date of Patent: Aug. 21, 2018

(54) DOOR SENSOR

(71) Applicants: Keith Lashley, Edmond, OK (US); Mitchell Davis, Jones, OK (US); Craig Morris, Edmond, OK (US); Matt Henson, Harrah, OK (US); Mark Simpkins, Stillwater, OK (US)

(72) Inventors: Keith Lashley, Edmond, OK (US); Mitchell Davis, Jones, OK (US); Craig Morris, Edmond, OK (US); Matt Henson, Harrah, OK (US); Mark Simpkins, Stillwater, OK (US)

(73) Assignee: Jasco Products Company LLC, Oklahoma City, OK (US)

( * ) Notice: Subject to any disclaimer, the term of this patent is extended or adjusted under 35 U.S.C. 154(b) by 0 days.

(21) Appl. No.: 15/162,412

(22) Filed: May 23, 2016

(51) Int. Cl.

| | |
|---|---|
| ***G08B 1/08*** | (2006.01) |
| ***E05D 11/00*** | (2006.01) |
| ***G08B 3/10*** | (2006.01) |
| ***G08B 21/18*** | (2006.01) |
| *E05D 3/02* | (2006.01) |

(52) U.S. Cl.
CPC ..... *E05D 11/00* (2013.01); *G08B 3/10* (2013.01); *G08B 21/182* (2013.01); *E05D 3/02* (2013.01); *E05Y 2400/66* (2013.01); *E05Y 2900/132* (2013.01)

(58) Field of Classification Search
None
See application file for complete search history.

(56) References Cited

U.S. PATENT DOCUMENTS

| | | | | |
|---|---|---|---|---|
| 5,930,954 | A * | 8/1999 | Hebda | E05F 15/63 49/28 |
| 6,276,743 | B1 * | 8/2001 | Jyawook | B60J 5/06 296/155 |
| 6,577,235 | B2 | 6/2003 | Frys | |
| 7,610,684 | B2 * | 11/2009 | Steinich | E05D 11/00 33/1 PT |
| 8,220,202 | B2 | 7/2012 | Riley | |
| 8,510,989 | B2 | 8/2013 | Riley | |
| 2001/0010429 | A1 * | 8/2001 | Jyawook | E05B 77/24 292/347 |
| 2009/0027198 | A1 * | 1/2009 | DiPoala | G08B 13/08 340/545.2 |
| 2016/0083990 | A1 * | 3/2016 | Ricks | E05D 11/00 16/223 |
| 2016/0084678 | A1 * | 3/2016 | Ricks | G01D 5/40 250/340 |
| 2017/0018155 | A1 * | 1/2017 | Ricks | E05D 11/00 |
| 2017/0084144 | A1 * | 3/2017 | Ricks | G08B 25/10 |

* cited by examiner

*Primary Examiner* — Julie Lieu
(74) *Attorney, Agent, or Firm* — Bruce P. LaBrie; Resolution Legal Group

(57) ABSTRACT

An apparatus includes a housing fixed adjacent to a door having a hinge, a rotating arm rotatable about the housing and biased toward the door, and a transmitter electronically coupled to the rotating arm, wherein the transmitter broadcasts a position of the door.

17 Claims, 3 Drawing Sheets

DOOR SENSOR

CROSS REFERENCE TO RELATED APPLICATIONS

This application claims the benefit of U.S. Provisional Application Ser. No. 62/208,876 entitled HINGE PIN DOOR SENSOR, filed Aug 24, 2015.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

The invention relates generally to a sensor for a door, and more particularly a sensor that determines the open or closed status or position of a door and communicates the status or position of the door.

Current solutions that indicate the status of a door include switches that employ magnetic sensors in the door and the door jamb. The sensors are typically installed in the door and door jamb by drilling a suitable sized hole to house the sensors. As the door is opened or closed, a change in the magnetic state of the flush mounted sensors indicates the state of the door has changed. Other sensors simply employ a switch at the interface of the door and the door jam, thereby causing a status change in the switch when the door is opened or closed. Yet other sensors are affixed by tape or brackets to the door and door jamb to effectuate the trigger of a magnetic switch when the door is opened. Still other sensors are incorporated into the hinge so that the movement of the hinge itself signals a status change. Yet other sensors are employed co-axially with the hinge pin of the door by using arms that extend radially from the hinge pin.

BRIEF SUMMARY OF THE INVENTION

Various embodiments of the present disclosure are generally directed to a door sensor.

In some embodiments, an apparatus includes a body having a catch attachable to a door hinge with a hinge pin. An arm rotatable abort an axis of the body is biased toward the door. A transmitter is electronically coupled to the arm and broadcasts a position of the door. The arm moves with the door and sends a position signal to the transmitter.

In other embodiments, the axis of the body is substantially parallel to the hinge. A receiver to receive a status signal is electronically coupled to the transmitter to send the status signal and the position signal. The transmitter is a transceiver that receives a status signal and transmits the status signal and the position signal. An enrollment switch is attached to the body and electrically coupled to the transmitter. A battery cavity in the body provides power to the position sensor. The catch is radially fixed to the body.

In yet other embodiments, a transmission node for communicating a position of a door having a hinge includes a housing having a connective arm for fixing the node to the hinge. A rotatable arm in contact with the housing and the door rotates about the housing. A transmitter electrically coupled to the rotatable arm broadcasts the position of the door.

In still other embodiments, the housing is substantially parallel to the hinge. The transmitter is a transceiver that receives a status signal and transmits the received signal and the position of the door. A receiver receives a status signal and is electronically coupled to the transmitter to broadcast the status signal. The housing includes a compartment for a power source. An enrollment switch is attached to the housing and electrically coupled to the transmitter. The connective arm is radially fixed to the housing.

In some embodiments an apparatus includes a housing fixed adjacent to a door having a hinge, a rotating arm rotatable about the housing and biased toward the door, and a transmitter electronically coupled to the rotating arm, wherein the transmitter broadcasts a position of the door.

In still other embodiments, the housing is substantially parallel to the hinge. A receiver receives a status signal and is electronically coupled to the transmitter to broadcast the status signal. The transmitter is a transceiver that receives a status signal and broadcasts the status signal and the position of the door.

DETAILED DESCRIPTION OF THE INVENTION

Figure 1:
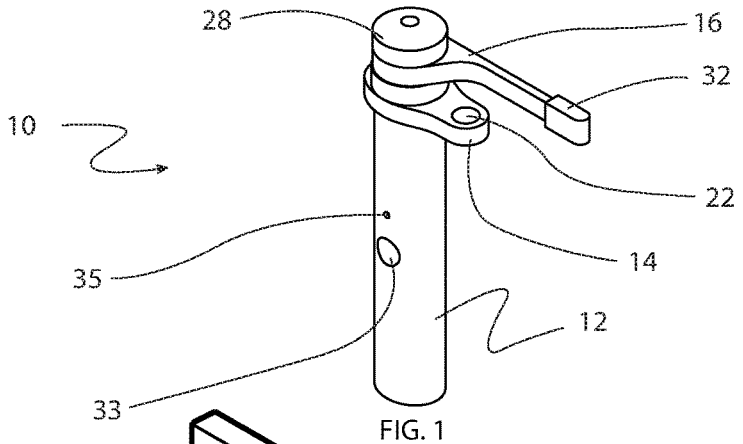
FIG. 1 is a perspective view of a door sensor in accordance with the present invention.
Figure 2:
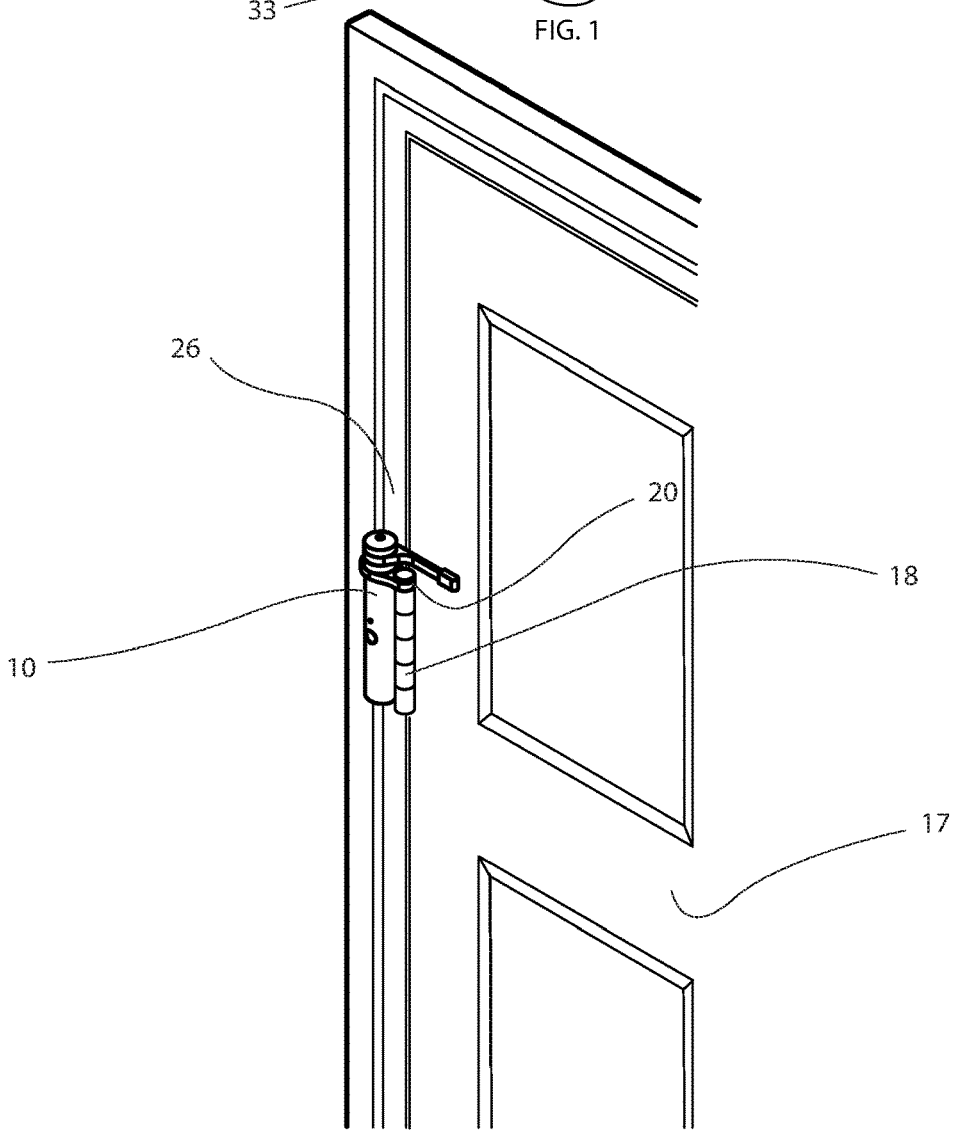
FIG. 2 is a perspective view of the door sensor of FIG. 1 installed on a door in accordance with the present invention.

Referring now to the drawings, and more particularly to FIG. 1, presently preferred embodiments of a door sensor are illustrated. A door sensor 10 has a body (or housing) 12, a catch (or connective arm) 14 removably attached to the body 10, a rotatable arm 16, and a transmitter 38 (see FIG. 3, not shown in FIG. 1). Referring also to FIG. 2, the door sensor 10 is shown adjacent a door 17, fixed in place substantially parallel to a hinge 18. A hinge pin 20 secures the door sensor 10 in place by extending through hole 22 in catch 14. An additional preferred embodiment provides a grommet in hole 22 to provide a better fit for the hinge pin 20. The grommet is preferably of rubber or a similarly flexible material that extends into hole 22 and includes a flange that is slightly larger than hole 22 to keep the grommet from falling through the hole 22.

In an alternate preferred embodiment, the door sensor 10 is fixed adjacent to door 17 using double sided tape, one or more screws through the housing, a mounting bracket or other means for fixing the sensor 10 to door molding 26 or other adjacent surface. In yet another preferred embodiment, the sensor 10 is fixed to the door molding 26 above the door or at any other location around the molding.

It is advantageous for catch 14 to be made from a rigid material such as durable plastic or metal, whether the door sensor 10 is attached adjacent to the door 17 using the catch 14 or using another method. This preferred embodiment protects the door sensor 10 from becoming crushed by the door 17 when opened to its full extent. In another alternate preferred embodiment, catch 14 is slightly larger than the cross section of body 12 to further resist damage to the door sensor 10.

Figure 6:
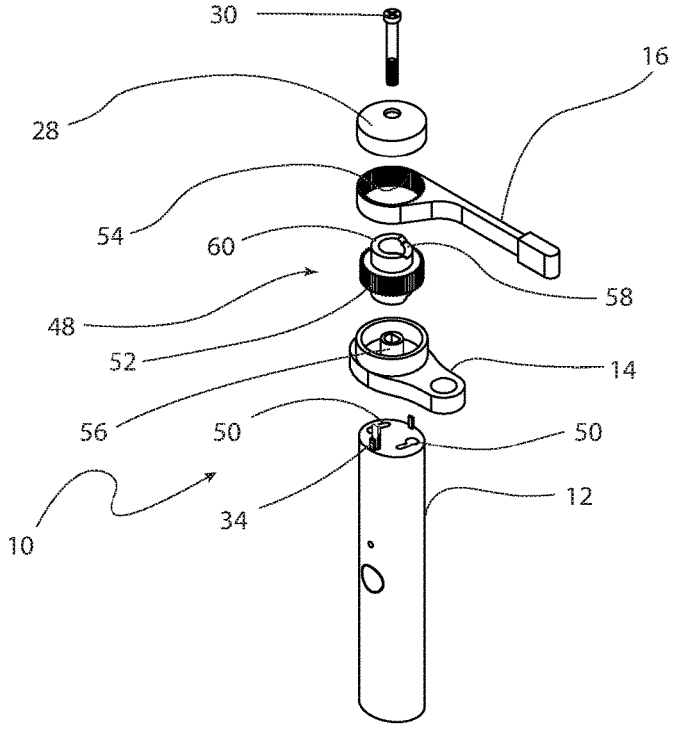
FIG. 6 is an exploded view of the door sensor of FIG. 1 in accordance with the present invention.

Additional preferred embodiments include a cap 28, which is secured to the body 12 using a screw 30 (also shown in FIG. 6.), and pad 32 at the end of arm 16. The cap 28 and screw 30 hold pieces such as the arm 16 and catch 14 securely to the body 12. The pad 32 provides a buffer between the arm 16 and the door 17 to prevent damage to the door 17. Also shown in FIGS. 1 and 2 is enrollment button 33 and LED 35.

Figure 3:
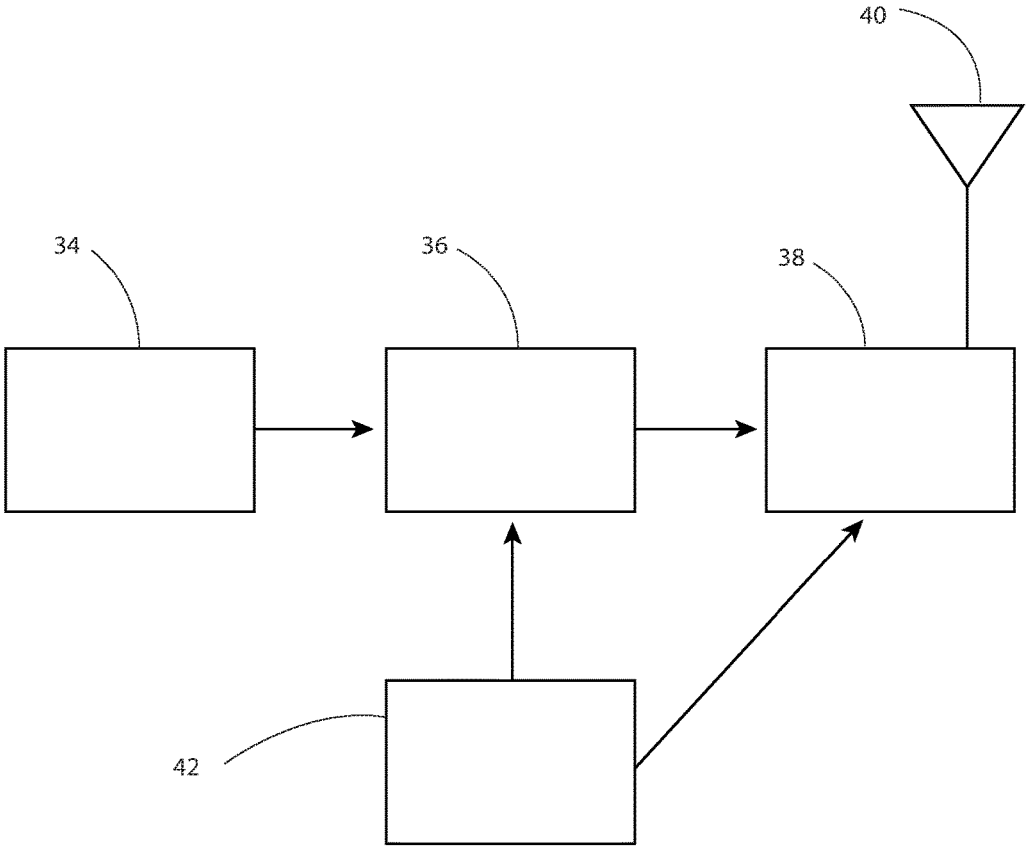
FIG. 3 is a schematic view of the door sensor of FIG. 1 in accordance with the present invention.

FIG. 3 shows a schematic view of the door sensor 10, components of which are preferably located in the housing 12. A switch 34 is preferably connected to a microprocessor 36, which is in turn connected to a transmitter 38, having antenna 40. It is contemplated that transmitter 38, in combination with antenna 40 or not, is capable of wired or wireless transmission. In some embodiments, the transmitter 38 is a speaker or other sound generating device. In a presently preferred embodiment, the microprocessor 36 and the transmitter 38 are powered by battery 42, such as a 3 volt CR2 battery. Alternate preferred embodiments can include AC power or any other electrical power source whether it requires a hard wired connection or a remote power source. The enrollment button 33 is electrically coupled to microprocessor 36, as is LED 35

Figure 4:
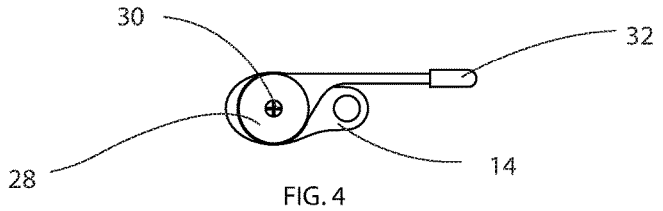
FIG. 4 is a top plan view of the door sensor of FIG. 1 in accordance with the present invention.

Referring now to FIG. 4, shown therein is a top view of the door sensor 10 with catch 14, arm 16, cap 28 and screw 30. The configuration of door sensor 10 in FIG. 4 is for a right hand door, as is evident in FIG. 2. Because doors are made in both left and right hand styles, it is advantageous for door sensor 10 to be usable for both styles of doors.

Figure 5:
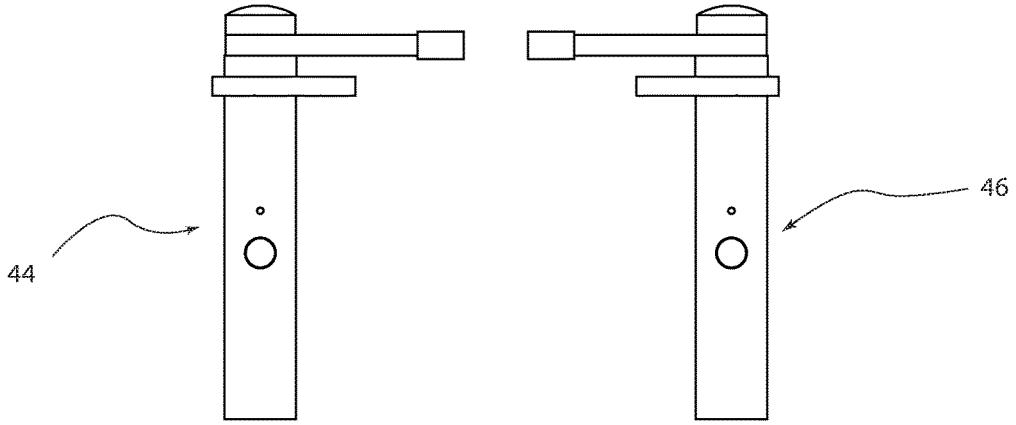
FIG. 5 is an elevation view of the door sensor of FIG. 1 in accordance with the present invention.

Referring to FIG. 5, door sensor 10 is shown in both a right hand configuration 44 and a left hand configuration 46. In a presently preferred embodiment, door sensor 10 is configurable for use with a left hand door or a right hand door. As shown in the exploded view of FIG. 6, door sensor 10 includes body 12, catch 14, arm 16, and reversible gear 48. The cap 28 and screw 30 secure the arm 16 and the reversible gear 48 to the catch 14. The body 12 and catch 14 are preferably secured by a pair of brads that extend from the catch 14 into graduated holes in the body 12. Heads at the ends of the brads hold the catch 14 to the body 12 by extending into the graduated holes 50 and providing resistance as the catch 14 is turned such that the heads are situated into a portion of the graduated holes 50 that is smaller than the heads.

The reversible gear 48 preferably includes radial teeth 52 that cooperatively interface arm teeth 54 on arm 16. Internally, the reversible gear 48 includes a torsion spring secured to an inner axial shaft that biases the inner axial shaft in a direction relative to the radial teeth 52. The inner axial shaft preferably includes a flattened side to firmly fit within shaft seat 56 on catch 14. Both ends of the inner axial shaft preferably include this feature so that the reversible gear 48 can be flipped for right and left hand operation. The reversible gear 48 also preferably includes an indentation 58 at each end of outer shaft 60 that interfaces switch 34.

To modify the door sensor 10 from a right hand configuration 44 to a left hand configuration 46, screw 30 and cap 28 are removed such that arm 16 can be lifted from reversible gear 48, which is in turn lifted from catch 14. To remove the catch 14 from the body 12, the catch 14 is rotate slightly to free the heads of the brads from the graduated holes 50. After lifting the catch 14 from the body 12, the catch 14 is then reinstalled by rotating about 180 degrees relative to the body 12 and inserting the brads into the graduated holes 50. The reversible gear 48 and the arm 16 are then flipped and the cap 28 and screw 30 are replaced to secure the parts in the new configuration.

In a presently preferred embodiment, markings on the arm 16 and the reversible gear 48 indicate a preferred radial position for the arm 16 on the reversible gear 48. For some situations it may be desirable to vary the radial position of the arm 16, for example, because of thick molding next to the door or unique features of the door. In another presently preferred embodiment, the radial teeth 52 are spaced at eight degree intervals to accommodate various installation requirements for situations such as these.

In operation, the door sensor 10 is affixed adjacent a door 17 (such as in FIG. 2) preferably using the catch 14 attached to the hinge 18 using hinge pin 20. In an alternate preferred embodiment, the body 12 is affixed adjacent to the door 17 using one or more screws, double sided tape or other means in which the body is firmly secured. The pad 32 on arm 16 preferably abuts or is in close proximity to the door 17 when the door 17 is closed. In an alternatively preferred embodiment, the arm 16 is a plunger (not shown) that abuts or is in close proximity to the door 17.

The enrollment button 33, when pressed, serves to signal to adjacent receiving devices that the door sensor 10 is in operation. The nearby receiving devices or transceiver devices then "listen" for status changes in the condition of the door 17 communicated by the door sensor 10. Alternatively, the sensor 10 automatically pairs itself with adjacent receiving devices.

As the door 17 is opened, the arm 16 rotates about the body 12 such that indentation 58 near switch 34 activates the switch 34, thereby activating microprocessor 36 to indicate that the door 17 is open. Alternatively, the plunger moves with the door and activates a switch and microprocessor 36. The transmitter 38 and antenna 40 then communicate a position signal of the door 17 as communicated from microprocessor 36. When the door 17 is closed, the position signal as indicated from the door sensor 10 is then transmitted to nearby receiving devices to communicate such. The position signal can indicate that the door 17 is closed, open, or some measure of open such as ajar, a few degrees, or anywhere between open and closed.

In an alternative preferred embodiment, transmitter 38 is a transceiver that receives status signals for other devices that are part of a network. The transceiver can then send both the position signal for the door 17 and status signals received from other devices on the network. The sent and received signals preferably use radio frequency signals, but one of ordinary skill in the art will readily recognize that the present invention is not so limited. For example, in some embodiments the transmitter 38 is a sound generator that transmits sounds that indicate the position of the door.

It is to be understood that even though numerous characteristics of various embodiments of the present disclosure have been set forth in the foregoing description, together with details of the structure and function of various embodiments, this detailed description is illustrative only, and changes may be made in detail, especially in matters of structure and arrangements of part within the principles of the present disclosure to the full extent indicated by the broad general meaning of the terms in which the appended claims are expressed. For example, the particular elements may vary depending on the particular application without departing from the spirit and scope of the present disclosure.

We claim:

1. A position sensor for a door hinge, comprising:

a body having a catch attachable to the hinge with a hinge pin;

an arm rotatable about an axis of the body and biased toward the door, wherein the axis of the body is substantially parallel to the hinge;

a transmitter electronically coupled to the arm that broadcasts a position of the door;

an enrollment switch attached to the body and electrically coupled to the transmitter;

wherein the arm moves with the door and sends a position signal to the transmitter.

2. The position sensor of claim 1, further comprising a receiver to receive a status signal that is electronically coupled to the transmitter to send the status signal and the position signal.

3. The position sensor of claim 1, wherein the transmitter is a transceiver that receives a status signal and transmits the status signal and the position signal.

4. The position sensor of claim 1, further comprising a battery cavity in the body to provide power to the position sensor.

5. The position sensor of claim 1, wherein the transmitter is a speaker that creates an audible sound.

6. The position sensor of claim 1, wherein the catch is radially fixed to the body.

7. A transmission node for communicating a position of a door having a hinge, comprising:

a housing having a connective arm for fixing the node to the hinge;

a rotatable arm in contact with the housing and the door that rotates about the housing;

a transmitter electrically coupled to the rotatable arm that broadcasts the position of the door;

an enrollment switch attached to the housing and electrically coupled to the transmitter.

8. The transmission node of claim 7, wherein the housing is substantially parallel to the hinge.

9. The transmission node of claim 7, wherein the transmitter is a transceiver that receives a status signal and transmits the received signal and the position of the door.

10. The transmission node of claim 7, further comprising a receiver that receives a status signal and is electronically coupled to the transmitter to broadcast the status signal.

11. The transmission node of claim 7, wherein the rotatable arm is a plunger in contact with the housing and the door that moves with the door.

12. The transmission node of claim 7, wherein the transmitter is a speaker that makes an audible sound.

13. The transmission node of claim 7, wherein the connective arm is radially fixed to the housing.

14. An apparatus, comprising;

a housing fixed adjacent to a door having a hinge;

a connective arm for fixing the apparatus to the hinge;

a rotating arm rotatable about the housing and biased toward the door;

a transmitter electronically coupled to the rotating arm, wherein the transmitter broadcasts a position of the door;

an enrollment switch attached to the housing and electrically coupled to the transmitter.

15. The apparatus of claim 14, wherein the transmitter is a sound generating device that generates a noise to indicate the position of the door.

16. The apparatus of claim 14, further comprising a receiver that receives a status signal and is electronically coupled to the transmitter to broadcast the status signal.

17. The apparatus of claim 14, wherein the transmitter is a transceiver that receives a status signal and broadcasts the status signal and the position of the door.

* * * * *